US009028053B2

(12) United States Patent
Suzuki et al.

(10) Patent No.: US 9,028,053 B2
(45) Date of Patent: May 12, 2015

(54) LIQUID EJECTING APPARATUS

(75) Inventors: Yoshiyuki Suzuki, Suwa (JP); Masaaki Ando, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 13/403,965

(22) Filed: Feb. 23, 2012

(65) Prior Publication Data

US 2012/0218355 A1 Aug. 30, 2012

(30) Foreign Application Priority Data

Feb. 28, 2011 (JP) ..... 2011-041185

(51) Int. Cl.

| | |
|---|---|
| ***B41J 2/17*** | (2006.01) |
| ***B41J 2/175*** | (2006.01) |
| ***B41J 2/015*** | (2006.01) |
| ***B41J 2/14*** | (2006.01) |

(52) U.S. Cl.

CPC ..... *B41J 2/14072* (2013.01)

(58) Field of Classification Search

CPC ..... B41J 2/175; B41J 2/17523

See application file for complete search history.

(56) References Cited

U.S. PATENT DOCUMENTS

| | | | | |
|---|---|---|---|---|
| 6,048,060 | A * | 4/2000 | Narushima et al. | 347/104 |
| 2009/0102879 | A1 * | 4/2009 | Katada et al. | 347/17 |
| 2009/0284572 | A1 * | 11/2009 | Katoh | 347/85 |

FOREIGN PATENT DOCUMENTS

JP 2004-167839 A 6/2004

* cited by examiner

*Primary Examiner* — Stephen Meier
*Assistant Examiner* — Renee I Wilson
(74) *Attorney, Agent, or Firm* — Kilpatrick Townsend & Stockton LLP

(57) ABSTRACT

A liquid ejecting apparatus including: a plurality of pressure chambers communicating with a plurality of nozzles respectively; and a plurality of liquid ejecting heads having a common liquid chamber configured to supply liquid common to the plurality of pressure chambers, wherein each of the liquid ejecting heads includes a liquid supply channel communicating with the common liquid chamber and supplying liquid from the liquid storage tank toward the common liquid chamber by the liquid feeding unit and a liquid discharge channel communicating with the common liquid chamber and discharging the liquid from the communicating chamber toward the liquid storage tank by the liquid feeding unit, and the directions of flows of the liquid in the common liquid chamber flowing from the liquid supply channels through the common liquid chamber toward the liquid discharge channels are opposite from each other between the adjacent liquid ejecting heads.

3 Claims, 7 Drawing Sheets

LIQUID EJECTING APPARATUS

BACKGROUND

1. Technical Field

The present invention relates to a liquid ejecting apparatus having a plurality of liquid ejecting heads arranged therein and, more specifically, to a liquid ejecting apparatus in which liquid in respective liquid ejecting heads are circulated.

2. Related Art

Examples of a liquid ejecting head which ejects liquid in a pressure chamber as liquid drops from nozzles by causing pressure variations in the liquid include an ink jet recording head (hereinafter, referred to simply as a recording head) used in an image recording apparatus such as an ink jet recording apparatus (hereinafter, referred to simply as a printer), a coloring material ejecting head used for manufacturing color filters for liquid-crystal displays, and so on, an electrode ejecting head used for forming electrodes for an organic EL (Electro Luminescence) display, an FED (Face Emitting Display), and so on, and a biological organic substance ejecting head used for manufacturing biochips (biochemical elements).

There is also a liquid ejecting apparatus including a recording head group (line-type recording head) having a plurality of recording heads arranged in the direction orthogonal to the direction of relative movement between the recording head and an object to be ejected (the direction of transporting the object to be ejected) in order to eject (discharge) liquid more efficiently and at a higher speed to the object to be ejected (recording medium). Examples of the recording head which constitutes the line-type recording head as described above include a type having a flow channel unit in which a line of a liquid flow channel from a reservoir via a pressure chamber to a nozzle is formed, or an oscillator unit having a piezoelectric oscillator which is capable of varying the capacity of the pressure chamber. There is also proposed a line-type recording head configured to cause liquid in reservoirs of the respective recording heads to circulate for the purpose of discharging foreign substance or air bubbles in the respective recording heads or for the purpose of preventing increase in viscosity of ink (for example, see JP-A-2004-167839).

Incidentally, as shown in FIG. 8A, when the liquid in the reservoir of the recording head 100 is circulated, the pressure is relatively high on the upstream side and is relatively low on the downstream side. Therefore, and hence the pressures in the pressure chambers located on the upstream side of the reservoir tend to be higher than those in the pressure chambers located on the downstream side. Therefore, the amounts of droplets to be ejected from the nozzles which communicate with the pressure chambers located on the upstream side tend to be larger than the amount of droplets to be ejected from the nozzles which communicate with the pressure chambers located on the downstream side. Then, in the line-type recording head as described above, since the directions of the flow of the liquid in the reservoirs in the respective recording heads 100 are the same, the difference in amounts of droplets to be ejected from the nozzles becomes maximum between adjacent nozzles of adjacent recording heads (see FIG. 8A). Arrows below the recording heads 100 in FIG. 8A are intended to give an idea of the amounts of droplets to be ejected from the nozzles, and show that the longer the length of the arrow, the larger the amount of droplets to be ejected from the nozzles is. In other words, in a configuration in which one hundred and eighty nozzles are provided on each of the recording head, the difference in amounts of droplets to be ejected between the nozzle No. 180 of one of the adjacent recording heads and the nozzle No. 1 of the other recording head reaches the greatest value. Therefore, for example, when ejecting the ink, the difference in amounts of droplets to be ejected is recognized as the difference in concentration of the liquid on the recording sheet (the object to be ejected) and, as shown in FIG. 8B, the difference in concentration between the recording heads are prominent as unevenness.

SUMMARY

An advantage of some aspects of the invention is a liquid ejecting apparatus having a line-type recording head which is capable of reducing the difference in amounts of droplets to be ejected from the nozzles between adjacent liquid ejecting heads.

According to an aspect of the invention, there is provided a liquid ejecting apparatus including: a plurality of pressure chambers communicating with a plurality of nozzles which constitute a nozzle row respectively; a plurality of liquid ejecting heads having a common liquid chamber configured to supply liquid common to the plurality of pressure chambers arranged in the nozzle row direction; a liquid storage tank having liquid stored therein; and a liquid feeding unit configured to feed liquid from the liquid storage tank toward the respective liquid ejecting heads, wherein each of the liquid ejecting heads includes a liquid supply channel communicating with one of the end portions of the common liquid chamber in the nozzle row direction and supplying liquid from the liquid storage tank toward the common liquid chamber by the liquid feeding unit and a liquid discharge channel communicating with the other one of the end portions of the common liquid chamber in the nozzle row direction and discharging the liquid from the communicating chamber toward the liquid storage tank by the liquid feeding unit, and the directions of flows of the liquid in the common liquid chamber flowing from the liquid supply channels through the common liquid chamber toward the liquid discharge channels are opposite from each other between the adjacent liquid ejecting heads.

In this configuration, the difference in amounts of droplets to be ejected from the adjacent nozzles between the adjacent liquid ejecting heads may be reduced. Accordingly, unevenness caused by the difference in concentration of liquid on the object to be ejected may be inhibited.

Preferably, a nozzle-to-nozzle distance in the nozzle row direction of the adjacent nozzles between the adjacent liquid ejecting heads is matched with a nozzle pitch of the nozzle row.

In this configuration, the liquid may be ejected without discontinuation between the liquid ejecting heads, and unevenness may be inhibited further reliably.

In this configuration, the adjacent liquid ejecting heads are preferably arranged so as to be shifted in the direction orthogonal to the nozzle row.

For example, even when the nozzle pitch of the nozzle row is narrow, the nozzle-to-nozzle distance in the nozzle row direction of the adjacent nozzles between the adjacent liquid ejecting heads may be matched with the nozzle pitch.

BRIEF DESCRIPTION OF THE DRAWINGS

The invention will be described with reference to the accompanying drawings, wherein like numbers reference like elements.

DESCRIPTION OF EXEMPLARY EMBODIMENTS

Referring now to attached drawings, best mode of the invention will be described below. In embodiments described below, various definitions are made as preferred embodiments of the invention. However, the scope of the invention is not limited to these modes unless otherwise specified in description given below to the effect of defining the invention. Also, in the following description, an ink jet recording apparatus 1 shown in FIG. 1 (hereinafter, referred to simply as a printer) will be described as an example of a liquid ejecting apparatus.

Figure 1:
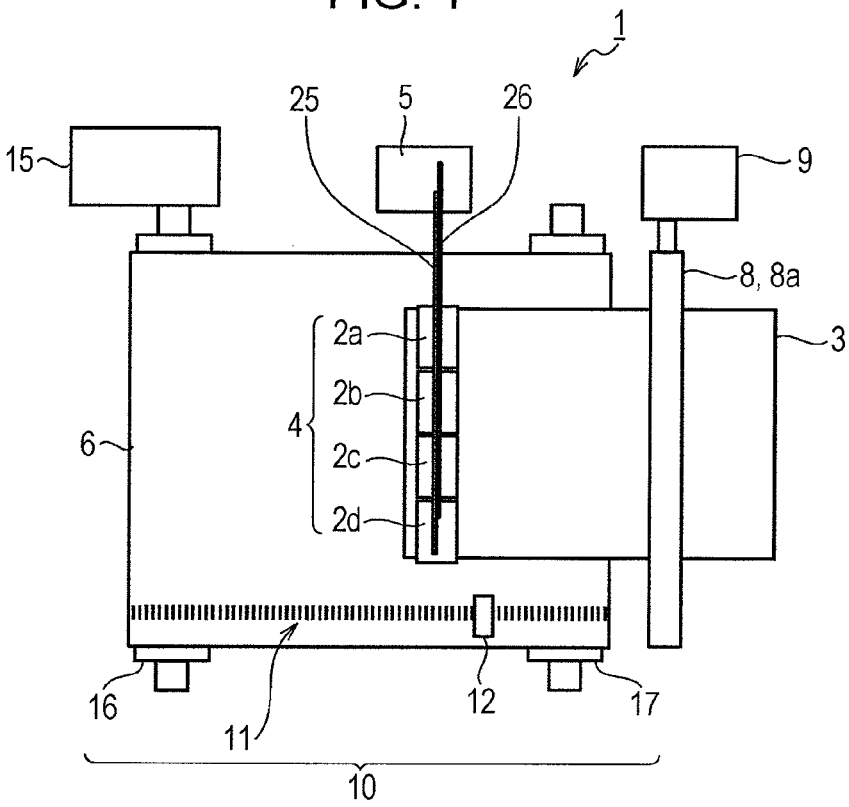
FIG. 1 is an explanatory plan view showing a configuration of a printer.
Figure 2:
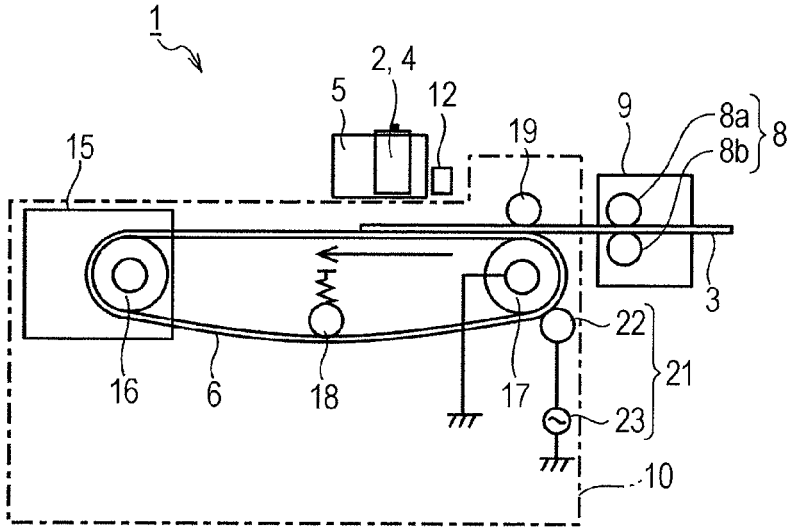
FIG. 2 is an explanatory side view showing the configuration of the printer.

FIG. 1 is an explanatory plan view showing a configuration of the printer 1, and FIG. 2 is a side view for explaining the configuration of the printer 1. The printer 1 includes a line-type recording head 4 having a plurality of recording heads 2 (a type of liquid ejecting head) arranged along the sheet-width direction of a recording sheet 3 (a type of recording medium or an object to be ejected) such as a roll sheet, for example (the direction orthogonal to the direction of transport of the recording sheet 3), an ink tank 5 (which corresponds to a liquid storage tank of the invention) in which ink to be supplied to the line-type recording head 4 is stored, a sheet feed roller 8 configured to supply the recording sheet 3 to the transporting belt 6, a sheet feed motor 9 configured to drive the sheet feed roller 8, a paper feeding roller 8 configured to supply the recording sheet 3 to the transporting belt 6, and a linear encoder including a linear scale 11 and a detection head 12. The printer 1 according to the first embodiment is a so-called line head type ink jet recording apparatus configured to only transport the recording sheet 3 at the time of recording operation, and does not involve the movement of the recording heads 2.

The sheet feed roller 8 is disposed on the upstream side of the transporting mechanism 10, and includes a pair of upper and lower rollers 8*a* and 8*b* which are capable of rotating synchronously in the directions opposite from each other in a state of clamping the recording sheet 3 supplied from a sheet feed portion, not shown. The sheet feed roller 8 is driven by a power from the sheet feed motor 9, and is configured to correct a skew of the recording sheet 3 with respect to the direction of transport of the recording sheet 3 and a positional displacement thereof in the direction orthogonal to the direction of transport of the recording sheet 3 in cooperation with a skew correcting roller, not shown, and then supply the recording sheet 3 toward the transporting mechanism 10.

The transporting mechanism 10 includes a transporting motor 15 which is a drive source of the transporting belt 6, a drive roller 16 to which the power is transmitted from the transporting motor 15, a driven roller 17 disposed on the upstream side with respect to the drive roller 16, the endless transporting belt 6 extended between the drive roller 16 and the driven roller 17, a tension roller 18 configured to apply a tension to the transporting belt 6, a press-contact roller 19 configured to press the recording sheet 3 toward the transporting belt 6, and a belt charging portion 21 configured to charge the transporting belt 6 (see FIG. 2). The tension roller 18 is disposed between the drive roller 16 and the driven roller 17, and inscribes in the transporting belt 6 to apply a tension to the transporting belt 6 by an urging force of an urging member such as a spring. The press-contact roller 19 is disposed right above the driven roller 17 across the transporting belt 6 and is in abutment with the transporting belt 6.

The belt charging portion 21 includes a charging roller 22 and a charging power source 23. The charging roller 22 is disposed below the driven roller 17 on the upstream side across the transporting belt 6 and is in abutment with the transporting belt 6. The charging power source 23 is connected to the charging roller 22 in conduction and applies an AC voltage to the charging roller 22. The driven roller 17 is grounded as shown in FIG. 2, and serves as an opposed electrode with respect to the charging roller 22 opposing thereto across the transporting belt 6. The belt charging portion 21 is configured in such a manner that the charging power source 23 supplies an electrical charge to the transporting belt 6 via the charging roller 22 and charges the transporting belt 6. Therefore, dielectric polarization occurs on the recording sheet 3 placed on the charged transporting belt 6, and an electrostatic adsorption power acts between the recording sheet 3 and the transporting belt 6. In addition, the press-contact roller 19 presses the recording sheet 3 placed on the charged transporting belt 6 against the transporting belt 6, and enhances the adhesiveness with respect to the transporting belt 6 of the recording sheet 3.

As shown in FIG. 1, the linear scale 11 is disposed on an outer peripheral surface of the transporting belt 6 over the entire circumference thereof. The linear scale 11 includes a plurality of slit-shaped detection patterns arranged at regular intervals (for example, 180 dpi) in the direction of transport of the transporting belt 6. The detection pattern of the linear scale 11 is optically detected by the detection head 12, and the detected signal is output to a control unit (not shown) of the printer 1 as an encoder signal. Therefore, the control unit is capable of knowing the amount of transport of the recording sheet 3 by the transporting mechanism 10 (the transporting belt 6) on the basis of the encoder signal. The encoder signal defines a drive signal generating timing for driving a pressure generating unit (a drive source) of the recording heads 2.

Provided on the outside of the transporting mechanism 10 of the printer 1 (for example, a housing of the printer 1) is the ink tank 5, and a supply channel 25 and a discharge channel 26 formed of tubes or the like communicate with the ink tank 5, thereby connecting the ink tank 5 and the line-type recording head 4. Provided at a midpoint of the supply channel 25 is a pump 27 (which corresponds to a liquid feed unit of the invention, see FIG. 5), so that the ink in the ink tank 5 may be fed toward the line-type recording head 4. The line-type recording head 4 according to the first embodiment includes four recording heads 2*a* to 2*d* arranged in the sheet width direction (the nozzle row direction, described later) configured to eject (discharge) ink of the same color on the side of the ink tank 5 as shown in FIG. 1 and the like. The supply channel 25 is branched into four channels before (the upstream side of) the recording heads 2*a* to 2*d*, and branched supply channels 25*a* to 25*d* communicate ends of the respective recording heads 2*a* to 2*d* on one side in the nozzle row direction respectively. In contrast, discharge channels 26*a* to 26*d* are connected to the respective recording heads 2*a* to 2*d* at the ends on the other side in the nozzle row direction, and the respective discharge channels 26*a* to 26*d* are joined together on the downstream side of the recording heads 2*a* to 2*d* and communicate with the ink tank 5 (see FIG. 5). Therefore, the ink in the ink tank 5 circulates in a circulating path passing through the supply channel 25, the flow channels in the respective recording heads 2, and the discharge channel 26 back to the ink tank 5 by the driving of the pump 27. Connections between the respective recording heads 2 and the supply channel 25 and the discharge channel 26 and circulation of the ink will be described later in detail.

Figure 3:
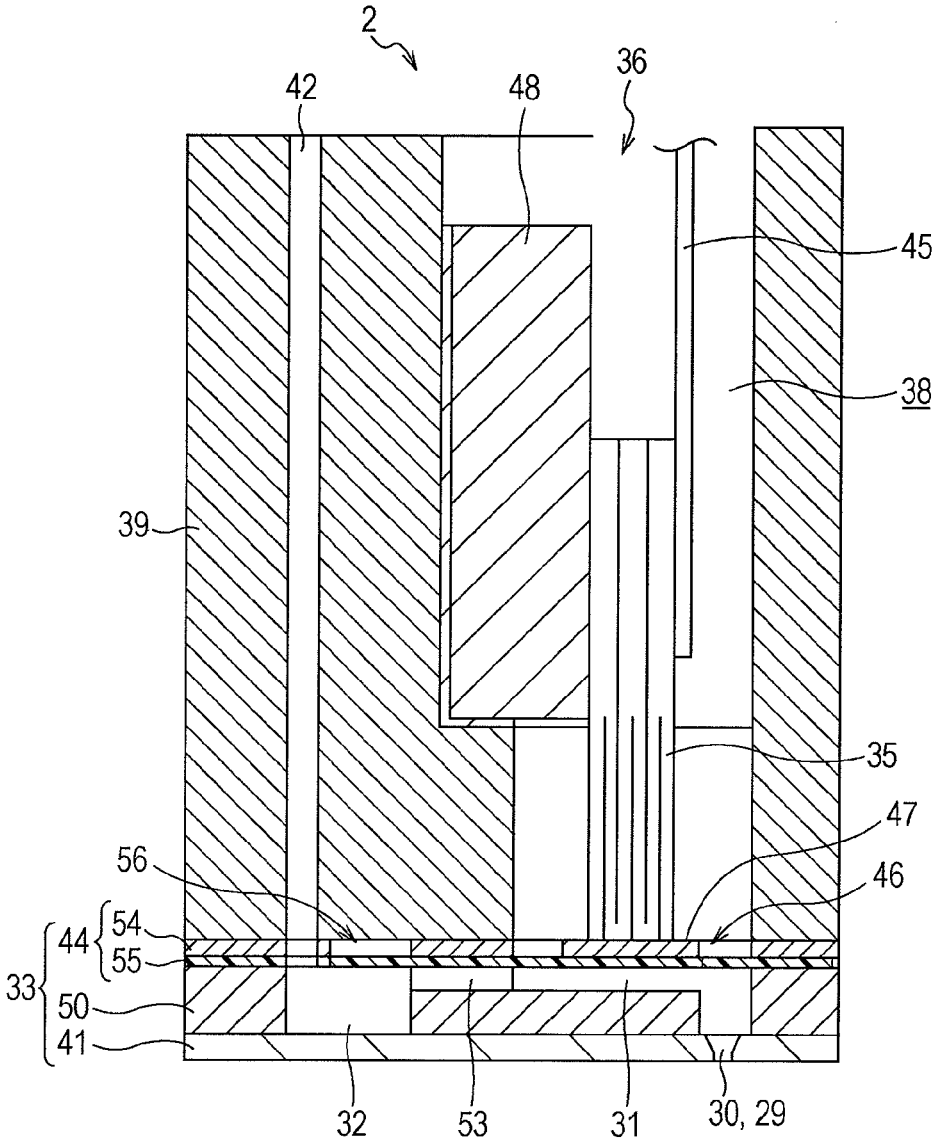
FIG. 3 is a cross-sectional view showing a principal portion of a recording head.

Subsequently, a configuration of the recording head 2 will be described in detail. FIG. 3 is a cross-sectional view showing a principal portion of the recording head 2. The recording head 2 according to the first embodiment includes a flow channel unit 33 having a plurality of pressure chambers 31 communicating respectively to a plurality of nozzles 30 which constitute a nozzle row 29, a reservoir 32 (which corresponds to a common liquid chamber of the invention) which is common for the plurality of pressure chambers 31 and configured to supply liquid, an oscillator unit 36 including piezoelectric oscillators 35 configured to generate pressure variations in the pressure chambers 31, and a head case 39 having a storage cavity 38 configured to store part of the oscillator unit 36 in the interior thereof. As described later, structures of the respective recording heads 2*a* to 2*d* are the same except that the positions of the case supply channel 42 and a case discharge flow channel 43 are inverted between the adjacent recording heads 2, and hence the single recording head 2 will be described as a representative below.

The head case 39 will be described first. The head case 39 is a hollow box-shaped member formed of a resin such as an epoxy-based resin and the flow channel unit 33 is fixed to the distal end side of the head case 39 in a state of exposing a nozzle plate 41 described later. Formed in the interior of the head case 39 are the storage cavity 38 for storing the oscillator unit 36, the case supply channel 42 for supplying ink from the supply channel 25 to the reservoir 32, and a case discharge flow channel 43 for discharging ink from the reservoir 32 to the discharge channel 26 so as to penetrate through the head case 39 in the height direction. More specifically, the case supply channel 42 communicates at one end thereof with the reservoir 32 via an ink introduction port of an oscillating panel 44 (described later) in a liquid-tight manner and at the other end thereof with the supply channel 25. The case discharge flow channel 43 communicates at one end thereof with the reservoir 32 via an ink deriving port of the oscillating panel 44 (described later) in a liquid-tight manner and at the other end thereof with the discharge channel 26.

The oscillator unit 36 will be described below. The oscillator unit 36 includes a piezoelectric oscillator group including a plurality of the piezoelectric oscillators 35 (a type of the pressure generating unit), and a flexible cable 45 (a wiring member). The piezoelectric oscillators 35 which constitute the piezoelectric oscillator group are formed into a comb shape elongated in the vertical direction and cut into extremely narrow widths on the order of several tens of μm. Then, the piezoelectric oscillator 35 is configured as the vertically oscillating piezoelectric oscillator 35 which is capable of being expanded and contracted in the vertical direction. The respective piezoelectric oscillators 35 are fixed in so-called a cantilevered state with free ends projecting outward from a distal end edge of a stationary plate 48 by joining fixing ends thereof to the stationary plate 48. Distal ends of the free ends of the respective piezoelectric oscillators 35 are respectively joined to island portions 47 which constitute a diaphragm portion 46 in the flow channel unit 33, described later. The flexible cable 45 is connected at one end thereof to the piezoelectric oscillators 35 at a side surface of the fixed end portion which is on the side opposite from the fixed panel 48, and at the other end thereof to the control unit of the printer 1. The fixed panel 48 configured to support the respective piezoelectric oscillators 35 is formed of a metallic plate member having an enough rigidity to receive reaction forces from the piezoelectric oscillators 35. In the first embodiment, the fixed panel 48 is formed of a stainless steel plate having a thickness on the order of 1 mm.

Subsequently, the flow channel unit 33 will be described. The flow channel unit 33 includes the nozzle plate 41, a flow channel formed substrate 50, and the oscillating panel 44, and is formed by arranging and laminating the nozzle plate 41 on one of surfaces of the flow channel formed substrate 50 and the oscillating panel 44 on the other surface of the flow channel formed substrate 50, which is the side opposite from the nozzle plate 41, respectively and integrating the same by adhesion or the like.

The nozzle plate 41 is a thin plate formed of stainless steel having the plurality of nozzles 30 arranged in a row at pitches corresponding to the dot formation density. In the first embodiment, the nozzle plate 41 is formed into a rectangular shape having long sides along the sheet width direction, and, for example, 180 nozzles 30 are formed in a row on one of the both long sides along the direction of the sheet width. These nozzles 30 which are formed in a row constitute the nozzle row 29.

The flow channel formed substrate 50 is a plate member on which a line of ink flow channel having the reservoir 32, the ink supply port 53, and the pressure chambers 31 are formed. The flow channel formed substrate 50 according to the first embodiment is formed by etching a silicon wafer. The pressure chambers 31 are chambers elongated in the direction orthogonal to the nozzle row direction, and the plurality of pressure chambers 31 are arranged in a row corresponding to the respective nozzles 30 in a state of being divided by partitions. An ink supply port 53 is formed as a narrowed portion having a narrow flow channel communicating the pressure chamber 31 and the reservoir 32. The reservoir 32 is a cavity for introducing ink common to the plurality of pressure chambers 31. The case supply channel 42 communicates with one end of the reservoir 32 in the nozzle row direction via the ink introduction port of the oscillating panel 44 and the supply channel 25 communicates with the case supply channel 42. Therefore, the ink may be supplied from the ink tank 5 via a line of flow channel (which corresponds to the liquid supply channel of the invention), the ink introduction port, the case supply channel 42, the supply channel 25, and to the reservoir 32. In contrast, the case discharge flow channel 43 communicates with the other end of the reservoir 32 in the nozzle row direction via the ink deriving port of the oscillating panel 44 and the discharge channel 26 communicates with the case discharge flow channel 43. Therefore, the ink in the reservoir 32 may be discharged toward the ink tank 5 via a line of flow channel (which corresponds to the liquid discharging channel of the invention), the ink deriving port, the case discharge flow channel 43, and the discharge channel 26.

The oscillating panel 44 is a composite plate member having a double structure formed by laminating a resin film 55 such as PPS (polyphenylene sulfide) on a supporting panel 54 formed of a metal such as stainless steel, and includes the ink introduction port which connects the reservoir 32 and the case supply channel 42 and the ink deriving port which connects the reservoir 32 and the case discharge flow channel 43 penetrate therethrough in the vertical direction. The oscillating panel 44 seals one of opened surfaces of the pressure chambers 31 (the surface opposite from the nozzle plate 41) to form the diaphragm portion 46 for varying the capacity of the pressure chambers 31, and form a compliance portion 56 configured to seal one of opening surfaces of the reservoir 32 (the surface opposite from the nozzle plate 41). More specifically, the diaphragm portion 46 is formed by etching portions of the supporting panel 54 corresponding to the pressure chambers 31, and forming a plurality of the island portions 47 for joining the distal ends of the free end portions of the piezoelectric oscillators 35 by removing the corresponding portions into an annular shape. The island portion 47 has a block shape elongated in the direction orthogonal to the direction of the row of the nozzles 30 in the same manner as the shape of the pressure chamber 31 in plan view, and the resin film 55 around the island portion 47 functions as a resilient film. A portion which functions as the compliance portion 56, that is, a portion corresponding to the reservoir 32 is formed by removing a portion of the supporting panel 54 along the shape of the opening of the reservoir 32 by etching and hence is formed only by the resin film 55.

In this manner, since distal end surfaces of the piezoelectric oscillators 35 are joined to the island portions 47, the capacities of the pressure chambers 31 may be varied by causing the free end portions of the piezoelectric oscillators 35 to be expanded and contracted in response to the drive signal fed from the control unit via the flexible cable 45. In association with the variation in capacities, the ink in the pressure chambers 31 is subjected to the pressure variations. The recording head 2 ejects (discharges) ink drops from the nozzles 30 by utilizing the pressure variations.

Figure 4:
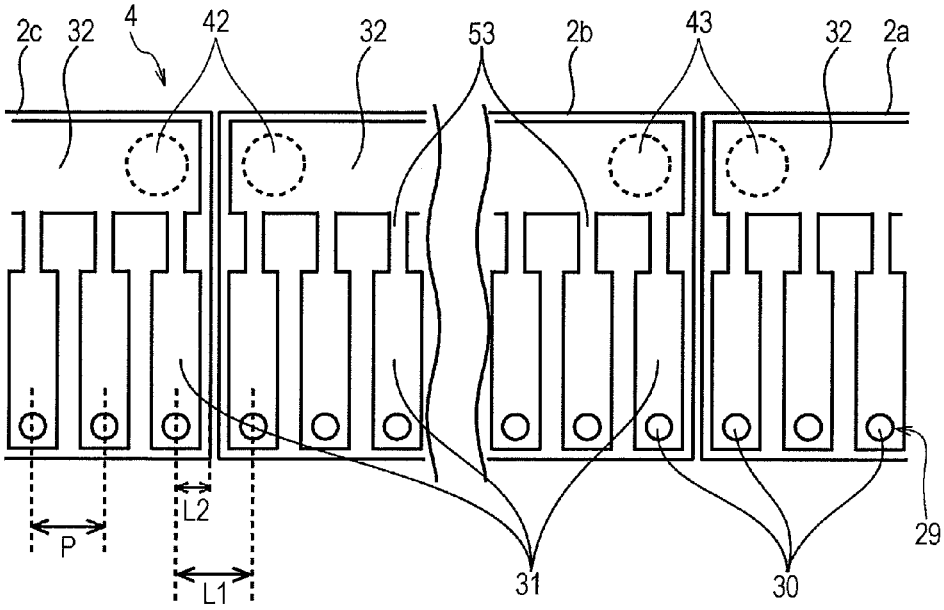
FIG. 4 is a plan view diagrammatically showing a flow channel unit of a line-type recording head.
Figure 5:
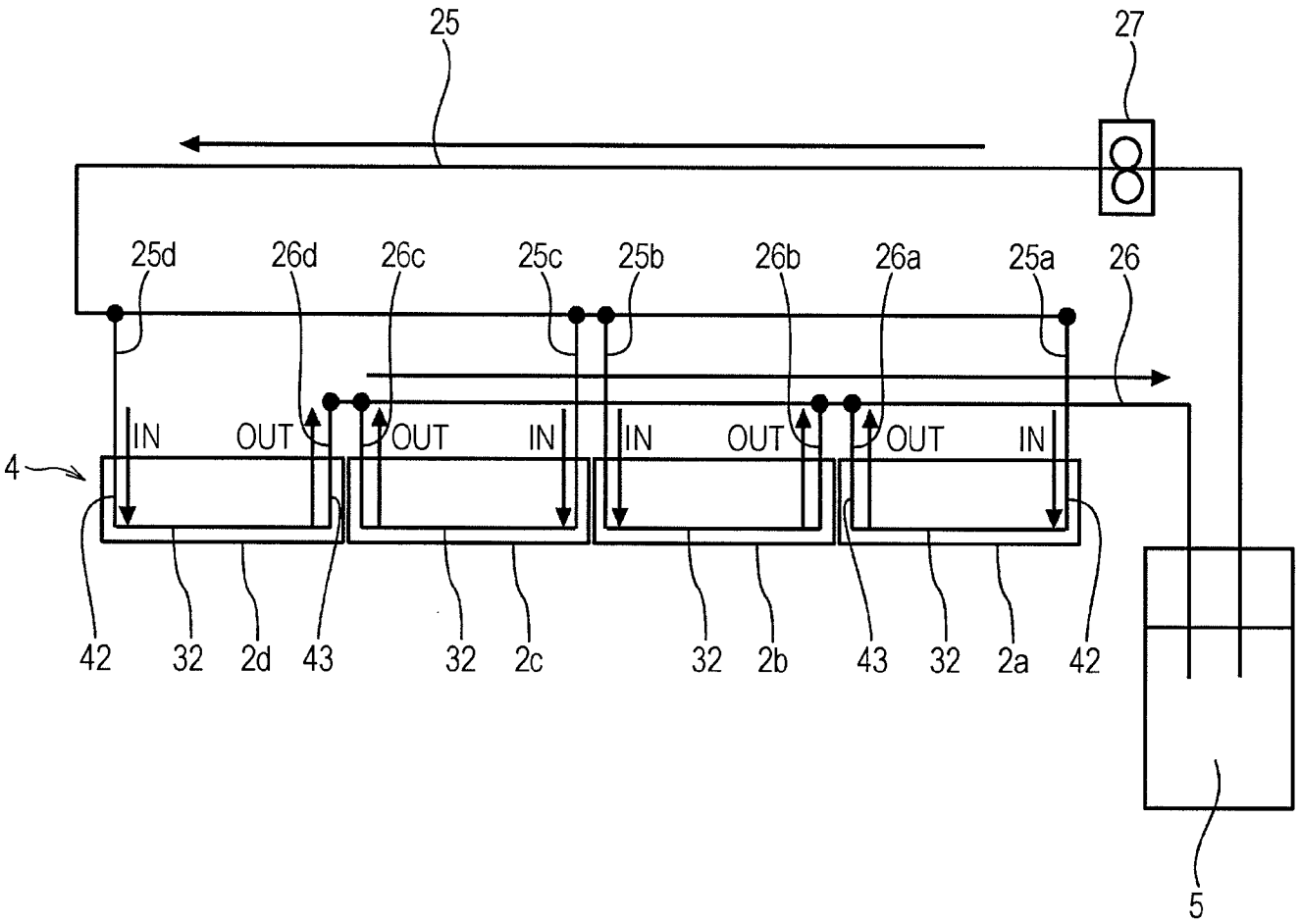
FIG. 5 is an explanatory diagrammatic drawing showing a circulation of ink of the printer.

Then, the line-type recording head 4 is configured by arranging four of the recording heads 2 described above in the nozzle row direction. In this case, the respective recording heads 2*a* to 2*d* are arranged so that the directions of the flows of the liquid in the reservoirs 32 from the case supply channel 42 through the reservoir 32 toward the case discharge flow channel 43 are opposite from each other between the adjacent recording heads 2. More specifically, as shown in FIG. 4 or the like, the recording heads 2*a* to 2*d* are arranged linearly so that the side surfaces of the adjacent recording heads 2*a* to 2*d* on the side of the case supply channel 42 in the nozzle row direction or the side surfaces of the recording heads 2*a* to 2*d* on the side of the case discharge flow channel 43 in the nozzle row direction oppose each other, respectively. For example, as shown in FIG. 5, from among the four recording heads 2*a* to 2*d* arranged in sequence from the side closer to the ink tank 5, the recording head 2*a* which is located at an end on the side of the ink tank 5 (the recording head 2 located at the right end in FIG. 5) and the recording head 2*c* located next to the recording head 2*d* located at the end on the side opposite from the ink tank 5 (the recording head 2 located at the third position from the right end in FIG. 5) includes the case supply channel 42 on the side of the ink tank 5 and the case discharge flow channel 43 on the side opposite from the ink tank 5 respectively, and the recording head 2*d* located at an end opposite from the ink tank 5 (the recording head 2 located at the left end in FIG. 5) and the recording head 2*b* located next to the recording head 2*a* located at an end on the side of the ink tank 5 (the recording head 2 located at the second position from the right end in FIG. 5) includes the case discharge flow channel 43 on the side of the ink tank 5 and the case supply channel 42 on the side opposite from the ink tank 5, respectively. Also, in the first embodiment, the recording heads 2*a* to 2*d* arranged in side by side are arranged so that the nozzle rows 29 of the respective recording heads 2*a* to 2*d* are aligned in a row (that is, aligned on one straight line). The respective recording heads 2 are formed so that a nozzle-to-nozzle distance L1 between the adjacent nozzles 30 of the adjacent recording heads 2 in the nozzle row direction is matched with a nozzle pitch P of the nozzle row 29 (see FIG. 4). In other words, the distance between the nozzle 30 of No. 180 of one of the adjacent recording heads 2 (the one on the side of the ink tank 5 according to the first embodiment) and the nozzle 30 of No. 1 on the other recording head 2 is matched with the nozzle pitch P. Therefore, a line of the nozzle row 29 having regular nozzle pitches is formed from the recording head 2 located at one end to the recording head located at the other end of the line-type recording head 4. A line of the nozzle row 29 is formed over a length equal to or larger than the width of the recording sheet 3. In this case, the recording head 2 is formed so that the distance L2 from the side surface on the side opposing the adjacent recording head 2 to the center of the nozzle 30 located at the end of the nozzle row 29 on the same side is half the nozzle pitch P or smaller.

Subsequently, the circulation of ink will be described. The circulation of ink is performed for the purpose of discharging foreign substances or air bubbles in the respective recording heads 2 or for the purpose of preventing increase in viscosity of the ink or settling of pigment particles contained in the ink. More specifically, the interior of the supply channel 25 is pressurized by driving the pump 27, and the ink stored in the ink tank 5 is caused to flow into the supply channel 25 toward the respective recording heads 2*a* to 2*d*. Then, the ink flowed into the supply channel flows in the supply channel 25, branched into the four channels on the upstream side of the recording heads 2*a* to 2*d*, and flows into the respective recording heads 2*a* to 2*d*. Since the resistances in the supply channel 25 and the discharge channel 26 are set to be low enough in comparison with the resistance of the flow channel in the recording head 2, the pressures applied to the flow channels (the reservoir 32) in the respective recording heads 2*a* to 2*d* are substantially equal. The ink flowed into each of the recording head 2 flows into the reservoir 32 via the case supply flow channel 42 and the ink introduction port and flows down in the reservoir 32. Here, the pressure in the reservoir 32 is reduced gradually from the upstream side (the case supply channel 42 side) to the downstream side (the case discharge flow channel 43 side). The ink flowing down in the reservoir 32 flows into the discharge channel 26 via the ink deriving port and the case discharge flow channel 43. The ink discharged from the respective recording heads 2*a* to 2*d* joins in the discharge channel 26 and flows down, and then flows into the ink tank 5. In such a circulating operation of the ink, the pressure applied to the interior of the circulating flow channel is adjusted to a level which does not cause the ink to be ejected from the nozzles 30 of the recording heads 2.

Figure 6A:
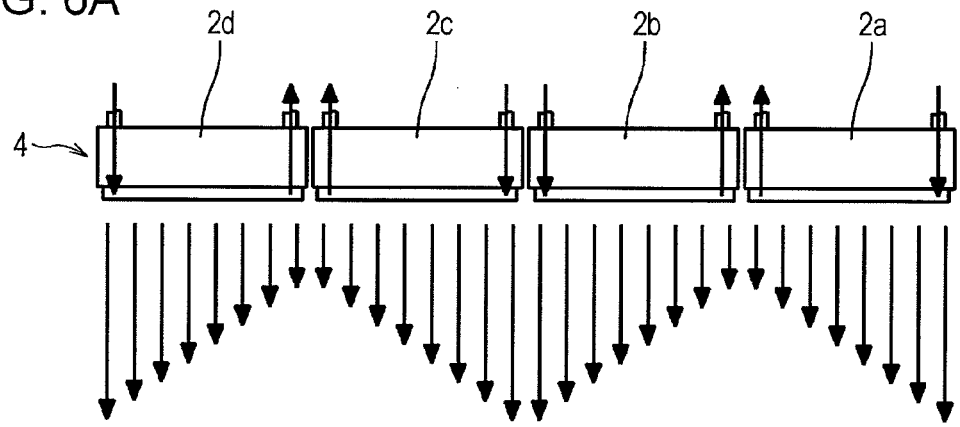
FIG. 6A is an explanatory drawing showing a picture of ejection of ink from the line-type recording head.

Subsequently, a recording operation of ink by the printer 1 will be described. First of all, the piezoelectric oscillators 35 are expanded and contracted in accordance with the drive signal sent from the control unit. Accordingly, the capacities of the pressure chambers 31 are varied and the pressures in the pressure chambers 31 are changed. The ink is ejected from the nozzles 30 by utilizing the pressure variations. Incidentally, since the ink in the reservoir 32 is circulated and the pressure is applied into the reservoir 32 as described above, the pressure in the reservoir 32 affects the pressures in the pressure chambers 31 as back pressures when ejecting the liquid from the nozzles 30. Then, since the pressure gradient from the upstream side (the case supply channel 42 side) toward the downstream side (the case discharge flow channel 43 side) is generated in the reservoir 32, larger pressure variations larger than the pressure chambers 31 on the downstream side are generated in the pressure chambers 31 on the upstream side. In association with these pressure variations, the amount of ejection of the ink is gradually reduced also from the upstream side toward the downstream side. (see FIG. 6A. The length of arrows below the recording heads 2 in FIG. 6A are intended to give an idea of the amount of ink to be ejected from the nozzles 30, and shows that the longer the length of the arrow, the larger the amount of droplets to be ejected from the nozzle is.)

Figure 6B:
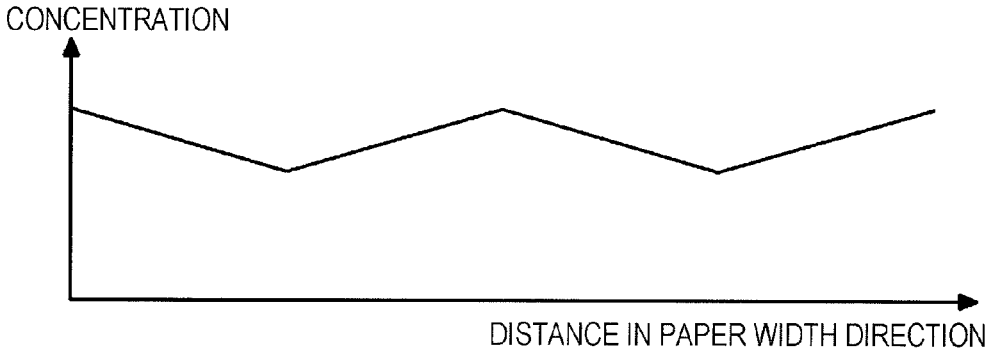
FIG. 6B is a graph showing the ejection of ink in FIG. 6A as concentrations of ink on a recording sheet.

Then, the printer 1 of the invention is capable of reducing the pressure difference between the adjacent pressure chambers 31 of the adjacent recording heads 2 since the direction of the liquid flows in the reservoir 32 from the case supply channel 42 through the reservoir 32 toward the case discharge flow channel 43 is set to be opposite from each other between the adjacent recording heads 2. Accordingly, as shown in FIG. 6A, the difference in amounts of ink to be ejected from the adjacent nozzles 30 between the adjacent recording heads 2 may be reduced. Consequently, unevenness caused by the difference in concentration of ink on the recording sheet 3 may be inhibited. More specifically, as shown in FIG. 6B, abrupt change of the difference in concentration of ink ejected from the respective nozzles 30 on the recording sheet 3 between the adjacent recording heads 2 is inhibited, and the change in concentration may be inhibited from being visually recognized as unevenness. Since the respective recording heads 2 are formed so that the nozzle-to-nozzle distance L1 between the adjacent nozzles 30 of the adjacent recording heads 2 in the nozzle row direction is matched with the nozzle pitch P of the nozzle row 29, ink may be ejected without discontinuation between the recording heads 2 and hence unevenness may be inhibited further reliably.

For example, in the recording head in which the nozzle pitch P is narrow, there may be a case where the length of the distance L2 from the center of the nozzle located at an end on one side of the nozzle row to the side surface on the same side in the nozzle row direction of the recording head is longer than half the nozzle pitch P due to the reason in terms of manufacture or securement of the strength. In such a case, if the recording heads are arranged linearly, the nozzle-to-nozzle distance L1 in the nozzle row direction between the adjacent nozzles of the adjacent recording heads is larger than the nozzle pitch P. Consequently, the difference in ink concentration occurs between the recording heads, which might be recognized as unevenness.

Figure 7:
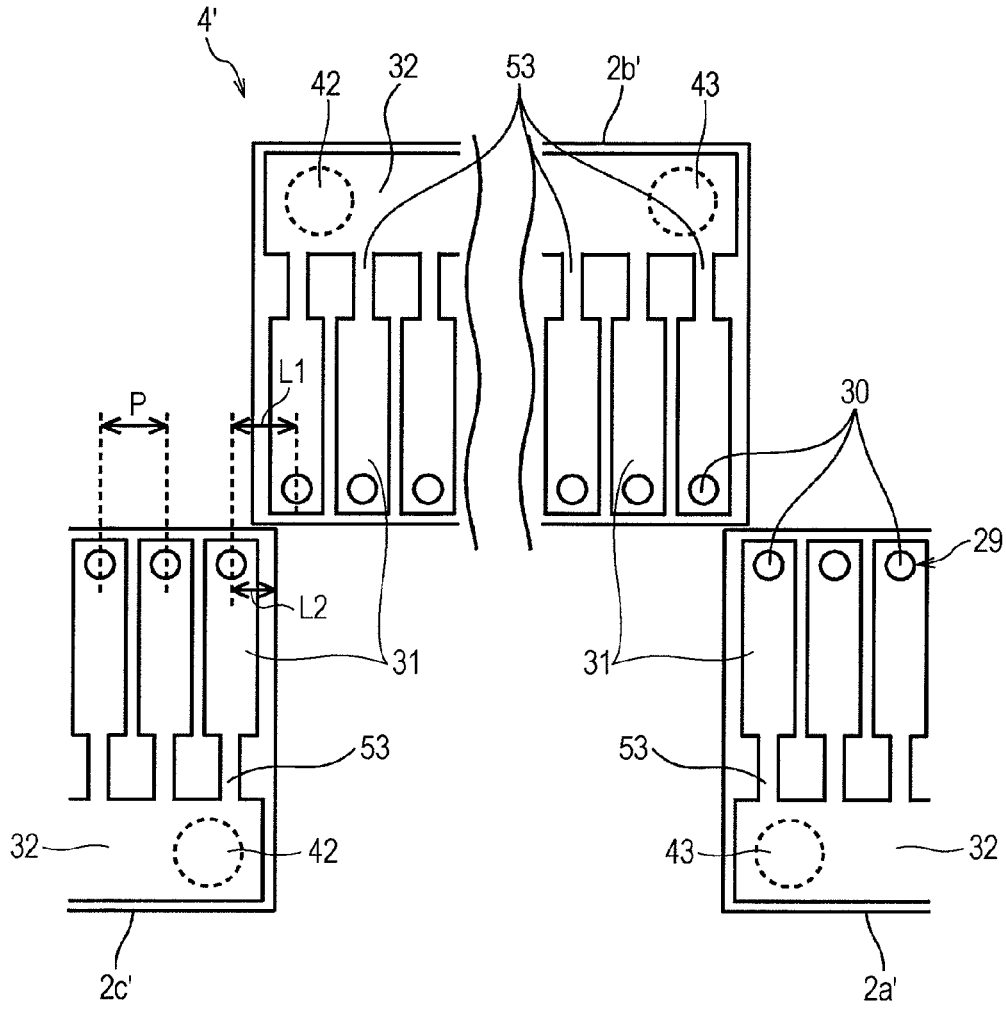
FIG. 7 is a plan view schematically showing the flow channel unit of a line-type recording head according to a second embodiment.
Figure 8A:
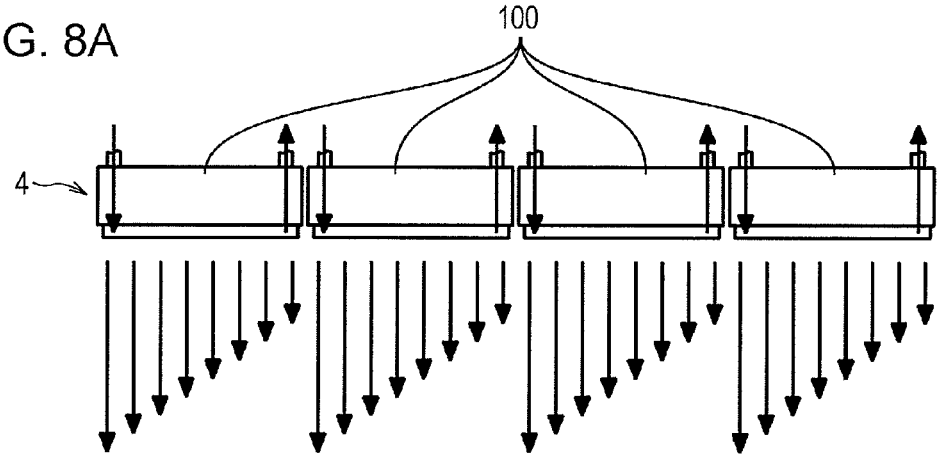
FIG. 8A is an explanatory drawing of a line-type recording head of the related art showing a picture of the ejection of ink of the line-type recording head.
Figure 8B:
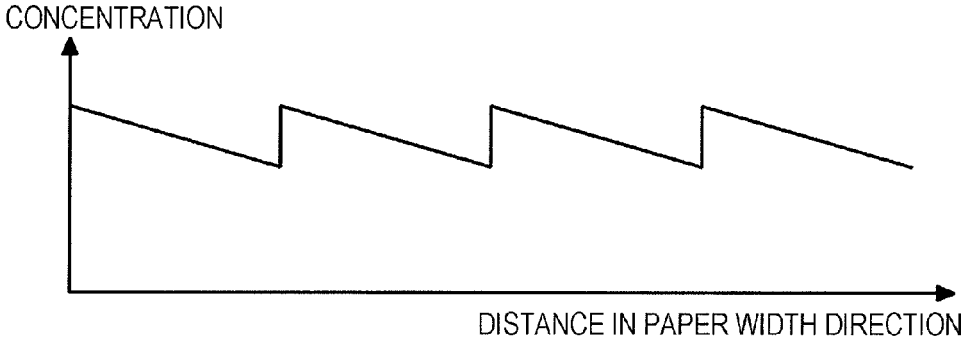
FIG. 8B is a graph showing the ejection of ink in FIG. 8A as concentrations of ink on a recording sheet.

Therefore, adjacent recording heads 2' are arranged in a state of being shifted in the direction orthogonal to the nozzle row 29 alternately in a line-type recording head 4' according to a second embodiment shown in FIG. 7. In the recording head 2' according to the second embodiment, although the length of a distance L2 from the center of the nozzle 30 located at an end on one side of the nozzle row 29 to the side surface of the recording head 2' on the same side in the nozzle row direction is set to be longer than half the nozzle pitch P, since the adjacent recording heads 2' are arranged so as to be shifted in the direction orthogonal to the nozzle row 29 alternately, the nozzle-to-nozzle distance L1 with respect to the nozzle row direction of the adjacent nozzles 30 between the adjacent recording heads 2' may be matched with the nozzle pitch P of the nozzle row 29. The respective recording heads 2' are arranged so as to avoid interference between the ends of the adjacent recording heads 2'. In the second embodiment, the respective recording heads 2' are arranged so that the end portions of the side surfaces which are closer to the nozzle row 29 from among the side surfaces parallel to the nozzle row 29 are brought closer and face inward so as to oppose each other in order to minimize the offset distance between the nozzle rows with respect to the direction of transport of the recording sheet 3 (the direction orthogonal to the nozzle row 29).

The recording heads 2' are arranged respectively so that the directions of the flows of the liquid in the reservoirs 32 of the adjacent recording heads 2' are opposite from each other. More specifically, as shown in FIG. 7, the case supply channels 42 or the case discharge flow channels 43 of the adjacent recording heads 2' are arranged adjacent to each other in the nozzle row direction. Also, in the second embodiment, the case supply channel 42 and the case discharge flow channel 43 are arranged on the outside of the recording heads 2' in the direction orthogonal to the nozzle row 29. Since other configurations are the same as those in the first embodiment, description will be omitted.

In this manner, the line-type recording head 4' according to the second embodiment is capable of reducing the pressure difference between the adjacent pressure chambers 31 of the adjacent recording heads 2' since the direction of the liquid flows in the reservoir 32 from the case supply channel 42 through the reservoir 32 toward the case discharge flow channel 43 is set to be opposite from each other between the adjacent recording heads 2'. Accordingly, the difference in amounts of ink to be ejected from the adjacent nozzles 30 between the adjacent recording heads 2' may be reduced. Consequently, unevenness caused by the difference in concentration of ink on the recording sheet 3 may be inhibited. More specifically, abrupt change of the difference in concentration of ink ejected from the respective nozzles 30 on the recording sheet 3 between the adjacent recording heads 2' is inhibited, and the change in concentration may be inhibited from being recognized as unevenness. Since the respective recording heads 2' are formed so that the nozzle-to-nozzle distance L1 between the adjacent nozzles 30 of the adjacent recording heads 2 in the nozzle row direction is matched with the nozzle pitch P of the nozzle row, the ink may be ejected without disconnection between the recording heads 2' and hence unevenness may be inhibited further reliably. Since the adjacent recording heads 2' are arranged so as to be shifted in the direction orthogonal to the nozzle row 29 alternately, for example, even when the nozzle pitch P of the nozzle row 29 is narrow, the nozzle-to-nozzle distance L1 in the nozzle row direction of the adjacent nozzles 30 between the adjacent recording heads 2' may be matched with the nozzle pitch P.

The invention is not limited to the embodiments described thus far. For example, although four of the recording heads are arranged in a line in the sheet width direction in the line-type recording head in the embodiments described above, the invention is not limited thereto. One of the aspects of the disclosure is only that at least two recording heads are arranged in a line in the sheet width direction.

Also, although one nozzle row is provided in the recording head in the line-type recording head in the embodiments described above, the invention is not limited thereto. For example, a plurality of the nozzle rows may be provided. Also, a plurality of the recording heads may be provided in the direction orthogonal to the nozzle row. One of the aspects of the invention is only that the directions of the flows of the liquid in the reservoirs of the adjacent recording heads are opposite from each other in the nozzle row direction between the corresponding reservoirs.

The invention may be applied to a method of manufacturing display manufacturing apparatuses configured to manufacture color filters such as liquid crystal displays, electrode manufacturing apparatuses configured to form electrodes such as organic electro luminescence displays or an FED (Face Emitting Display), chip manufacturing apparatuses configured to manufacture biochips (biochemical elements), and micro pipettes configured to supply a very small amount of sample solution by an accurate amount.

The entire disclosure of Japanese Patent Application No. 2011-041185, filed Feb. 28, 2011 is expressly incorporated by reference herein.

What is claimed is:

1. A liquid ejecting apparatus comprising:

a plurality of pressure chambers communicating with a plurality of nozzles which constitute a nozzle row;

a plurality of liquid ejecting heads having a common liquid chamber configured to supply liquid common to the plurality of pressure chambers disposed in the nozzle row direction;

a liquid storage tank configured to store liquid therein; and a liquid feeding unit configured to feed liquid from the liquid storage tank toward the liquid ejecting heads, wherein each of the liquid ejecting heads is in fluid communication with:

a main liquid supply channel communicating with the common liquid chamber and configured to supply liquid from the liquid storage tank toward the common liquid chamber by the liquid feeding unit; and a main liquid discharge channel communicating with the common liquid chamber and configured to discharge the liquid from the common liquid chamber toward the liquid storage tank by the liquid feeding unit, wherein the main liquid discharge channel is separate from the main liquid supply channel;

wherein the plurality of liquid ejecting heads comprises a first liquid ejecting head and a second liquid ejecting head adjacent the first liquid ejecting head;

wherein the first liquid ejecting head is in fluid communication with:

a first liquid supply channel communicating with the main liquid supply channel, and a first liquid discharge channel communicating with the main liquid discharge channel;

wherein the second liquid ejecting head is in fluid communication with:

a second liquid supply channel communicating with the main liquid supply channel, wherein the second liquid supply channel is separate from the first liquid supply channel, and a second liquid discharge channel communicating with the main liquid discharge channel, wherein the second liquid discharge channel is separate from the first liquid discharge channel;

wherein the liquid supply channels are configured in one of the two following ways:

the first liquid supply channel is disposed near a first end of the first liquid ejecting head adjacent the second liquid ejecting head, the first liquid discharge channel is disposed near a second end of the first liquid ejecting head distal from the second liquid ejecting head, the second liquid supply channel is disposed near a first end of the second liquid ejecting head adjacent the first end of the first liquid ejecting head, and the second liquid discharge channel is disposed near a second end of the second liquid ejecting head distal from the first liquid ejecting head, such that the first and second liquid supply channels are adjacent one another and the first and second liquid discharge channels are distal of the first and second liquid supply channels; or the first liquid discharge channel is disposed near the first end of the first liquid ejecting head, the first liquid supply channel is disposed near the second end of the first liquid ejecting head, the second liquid discharge channel is disposed near the first end of the second liquid ejecting head, and the second liquid supply channel is disposed near the second end of the second liquid ejecting head, such that the first and second liquid discharge channels are adjacent one another and the first and second liquid supply channels are distal of the first and second liquid discharge channels.

2. The liquid ejecting apparatus according to claim 1, wherein a nozzle-to-nozzle distance in the nozzle row direction of the adjacent nozzles between the first and second liquid ejecting heads is matched with a nozzle pitch of the nozzle row.

3. The liquid ejecting apparatus according to claim 2, wherein the first and second liquid ejecting heads are shifted in a direction orthogonal to the nozzle row.

* * * * *